US005758019A

United States Patent [19]

Klopotek

[11] Patent Number: 5,758,019

[45] Date of Patent: May 26, 1998

[54] RADIATIVE KEYBOARD HEATING APPARATUS

[76] Inventor: Peter J. Klopotek, 2 Bayberry La., Framingham, Mass. 01701

[21] Appl. No.: 640,135

[22] Filed: Apr. 30, 1996

[51] Int. Cl.[6] ..... F24D 19/02

[52] U.S. Cl. ..... 392/432; 392/435; 219/455; 219/463; 219/473

[58] Field of Search ..... 392/432–436, 392/407, 415, 411–414, 410; 219/217, 200, 201, 521, 218, 520, 443, 447, 455, 458, 463, 473; 400/713–717; 607/111, 108; 362/190, 191, 253; 361/680, 681; 126/92 A

[56] References Cited

U.S. PATENT DOCUMENTS

| | | | |
|---|---|---|---|
| 861,560 | 7/1907 | Turner et al. . | |
| 1,376,593 | 5/1921 | Tuttle | 392/413 |
| 2,415,641 | 2/1947 | Langsdorf | 400/714 |
| 2,613,308 | 10/1952 | Mirand | 392/435 |
| 3,309,500 | 3/1967 | Reynolds | 392/435 |
| 3,548,184 | 12/1970 | Fletcher | 362/190 |
| 4,449,763 | 5/1984 | Barnett | 312/208 |
| 4,650,965 | 3/1987 | Lawson | 392/435 |
| 5,036,436 | 7/1991 | Rattigan et al. | 362/33 |
| 5,158,256 | 10/1992 | Gross | 400/715 |
| 5,193,523 | 3/1993 | Denber | 126/204 |
| 5,214,739 | 5/1993 | Nelson et al. | 392/432 |
| 5,360,374 | 11/1994 | Wyon et al. | 454/306 |
| 5,369,560 | 11/1994 | Friedman | 362/190 |
| 5,379,201 | 1/1995 | Friedman | 362/191 |
| 5,402,972 | 4/1995 | Schmidt | 400/715 |
| 5,419,704 | 5/1995 | North | 400/714 |
| 5,445,349 | 8/1995 | Hart | 400/715 |
| 5,462,247 | 10/1995 | Aldrich | 400/715 |

FOREIGN PATENT DOCUMENTS

| | | | |
|---|---|---|---|
| 494842 | 6/1954 | Italy | 400/716 |
| 3-103911 | 4/1991 | Japan . | |
| 237750 | 9/1945 | Switzerland . | |

OTHER PUBLICATIONS

Passafiume, J.E., "Positive Pressure Keyboard Contamination Shield," *IBM Technical Disclosure Bulletin*, vol. 25, No. 4, (Sep. 1982).

*Primary Examiner*—Tu B. Hoang

*Attorney, Agent, or Firm*—Thomas J. Engellenner; Lahive & Cockfield, LLP

[57] ABSTRACT

Methods and apparatus are disclosed for warming a typist's hands to provide relief from arthritis, muscle fatigue, Carpal Tunnel Syndrome and general discomfort. A radiative hand warming apparatus includes, including a source of hand-warming radiation, and a holder for supporting the radiation source in proximity to a keyboard or other manual operation device, such that the user's hands can be warmed by radiant energy during typing. In one embodiment, the source of hand-warming radiation emits radiation having an intensity of about 10 to about 150 milliwatts/square centimeter as measured at the typist's hands. The radiation source can be, for example, an infrared (IR) radiation source. Such an infrared radiation source preferably emits IR radiation in at least a portion of the spectrum from about 1 to about 30 micrometers.

21 Claims, 2 Drawing Sheets

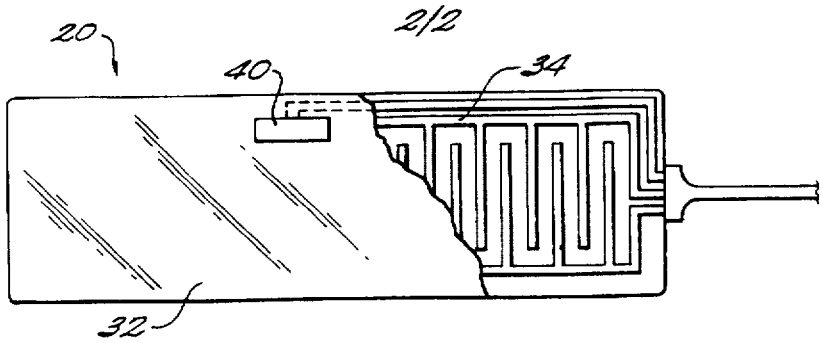
FIG. 3
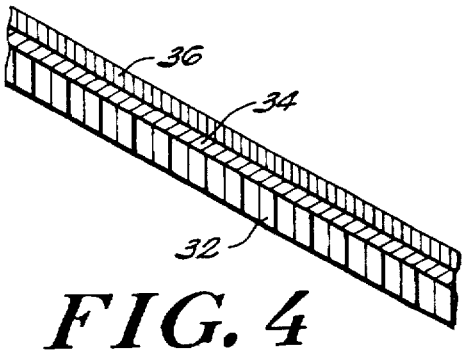
FIG. 4
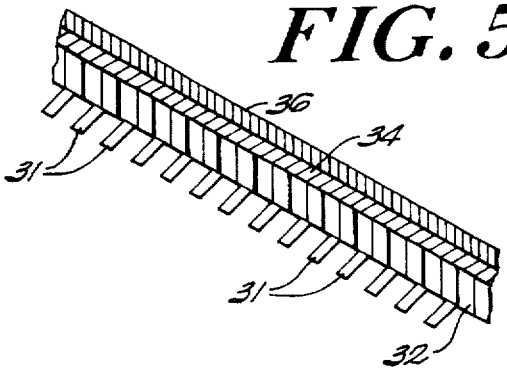
FIG. 5
FIG. 6
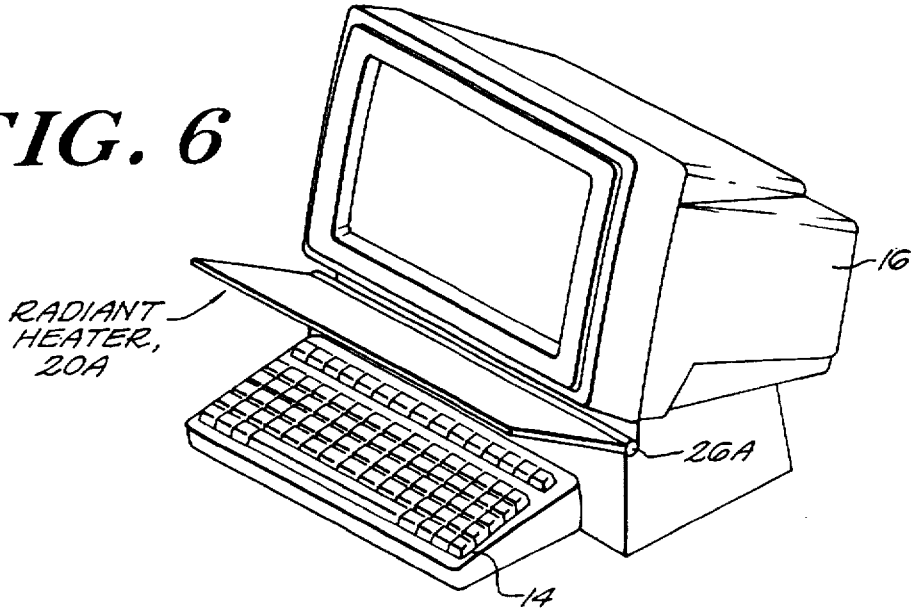

RADIATIVE KEYBOARD HEATING APPARATUS

Background of the Invention

The technical field of this invention is heating elements and, in particular, apparatus for heating hands during repetitive manual operations, such as keystroke execution of word processing equipment and the like.

The hands and fingers of typists are typically subjected to both cold air and repetitive stresses as the result of keystroke execution during word processing. Typists oft complain about coldness in their fingers and the associated subjective feeling of stiffness. This stiffness can become so acute as to impair the efficiency of typing.

In addition, there are many clinically recognized syndromes and/or injuries which appear to be exacerbated by exposure to cold air. For example, Carpal Tunnel Syndrome ("CTS") is a well-known illness which can affect typists. This syndrome is associated with inflammation of one or more different tendons in the hand. When a typist suffering from CTS works in a cold environment, the pain associated with this syndrome is often aggravated. The lower temperature of the hands appears to reduce the circulatory support for tendons so that tendon inflammation becomes more pronounced and may also become chronic.

Accordingly, it is an objective of the present invention to provide relief to typists and others who engage in repetitive manual operations involving keyboards and the like by reducing stiffness and/or stress syndromes associated with a cold working environment. An apparatus which could provide warmth to a typist's hands without interfering with the manual keystroke operations would satisfy a long-felt need in the art.

SUMMARY OF THE INVENTION

Methods and apparatus are disclosed for warming a typist's hands to provide relief from arthritis, muscle fatigue, Carpal Tunnel Syndrome and general discomfort. A radiative hand warming apparatus is disclosed, including a source of hand-warming radiation, and a holder for supporting the radiation source in proximity to a keyboard or other manual operation device, such that the user's hands can be warmed by radiant energy during typing.

In one embodiment, the source of hand-warming radiation emits radiation having an intensity of about 10 to about 150 milliwatts/square centimeter as measured at the typist's hands. The radiation source can be, for example, an infrared (IR) radiation source. Such an infrared radiation source preferably emits IR radiation in at least a portion of the spectrum from about 1 to about 30 micrometers.

In an embodiment particularly adapted for warming a typist's hands during use of a keyboard, the radiation source is a large area radiation emitter and is positionable in relationship to the hands of the typist at such a distance and orientation such that the radiation intensity of the source measured at the source is approximately equal to the radiation intensity measured at the typist's hands. Preferably, the large area radiation emitter has a surface area greater than about 100 square centimeters. Various radiation sources can be used in the present invention, including resistive electric heating elements, such as etched metal foil elements, conductive ceramic elements, conductive polymeric elements, and thin metal film resistive elements.

In one illustrated embodiment, a visually transparent resistive electric heating element is disclosed. This material is disclosed without or together with a visually transparent cover material through which the radiation is transmitted or from which the radiation is emitted to the typist's hands. In this embodiment, a largely visually transparent radiation source is deployed to minimize any visual distraction during keystroke operations.

In another embodiment, the radiation source can comprise the heating element with an infra red transparent cover material through which radiation can be transmitted to the typist's hands. The cover material is in this case an infrared window.

In yet another embodiment, the radiation source can comprise a heating element which transmits heat to a cover material which, in turn, emits radiation, e.g., infrared radiation, from its surface to the typist's hands. The cover material, preferably, has an emission coefficient greater than about 0.3. Suitable cover materials include, for example, Kapton™ materials, Mylar™ materials, and the like.

In yet another embodiment, the radiation source can comprise a simple heating element without any cover.

In other embodiments the apparatus can further include a reflector, or other infrared radiation redirecting or redistributing means, to redirect a portion of the radiation emitted from the heating element towards the typist hand.

In another aspect of the invention, a mechanical stand is disclosed for positioning the radiation source above the keyboard and facilitating adjustments, as desired, by the user. The stand can include at least one surface-engaging leg, which serves to stabilize the holder and allows for positioning of the radiation source independently of the keyboard. Alternatively, the radiation source can be mounted on a holder which is integrated with either the keyboard or a monitor.

The apparatus further, preferably, includes an adjustment means for adjusting the incident angle of the source relative to the keyboard.

In yet another aspect of the invention, methods are disclosed for treating illnesses associated with repetitive keyboard actions employing the above-described apparatus at particular operating parameters.

BRIEF DESCRIPTION OF THE DRAWINGS

FIG. 3 is a schematic, partially cutaway, top view of a radiation source for use in the present invention;

FIG. 4 is a schematic cross-sectional view of a radiation source, such as that shown in FIG. 3;

FIG. 5 is a schematic cross-sectional view of an alternative radiation source with deflector elements; and FIG. 6 is a schematic, perspective view of an alternative embodiment of the invention.

DETAILED DESCRIPTION

Figure 1:
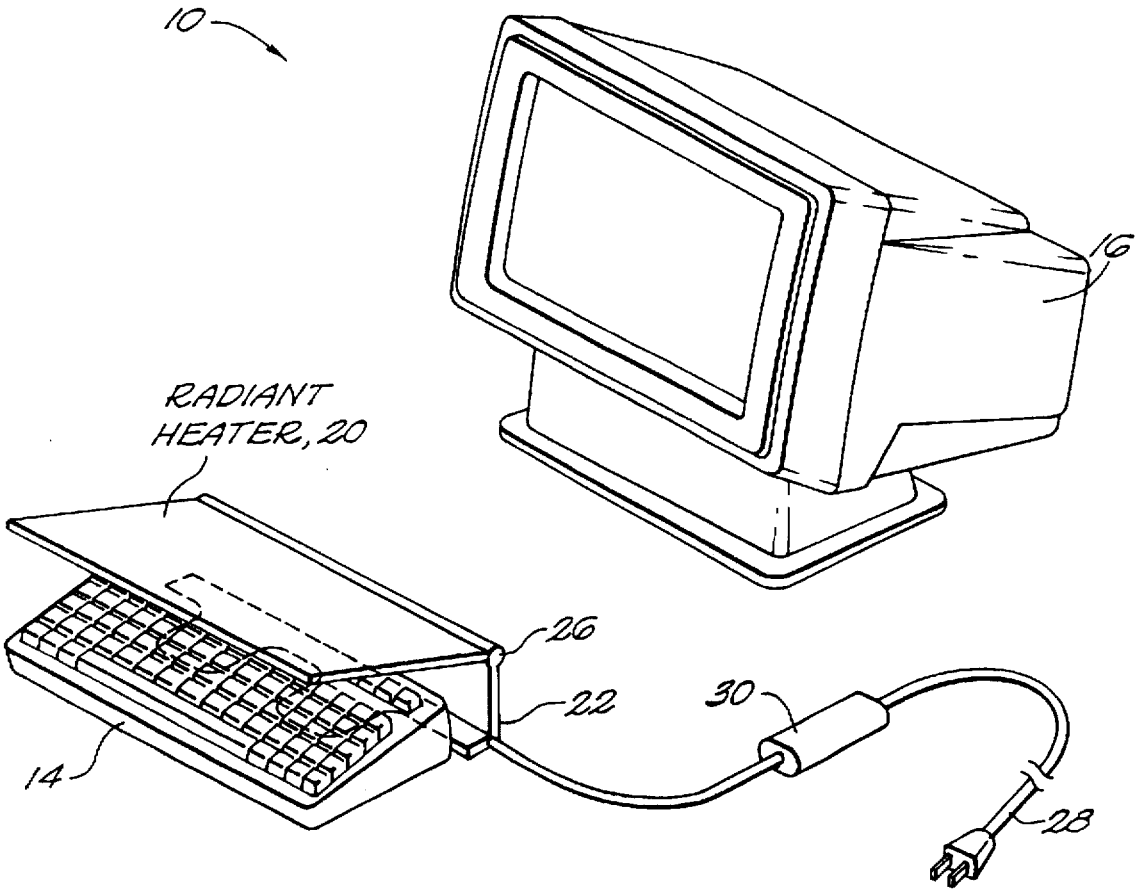
FIG. 1 is a schematic perspective view of an illustrative keyboard heating apparatus according to the invention.

In FIG. 1, an apparatus 10 for warming a typist's hands is shown in connection with a keyboard 14 and a monitor 16. The apparatus 10 further includes a radiation source 20 having a stand 22 and an adjustable hinge 26. The apparatus further includes a power cord 28 and, optionally, a transformer/controller 30 for converting standard AC voltage to a lower voltage or DC current to power the radiation source 20.

Figure 2:
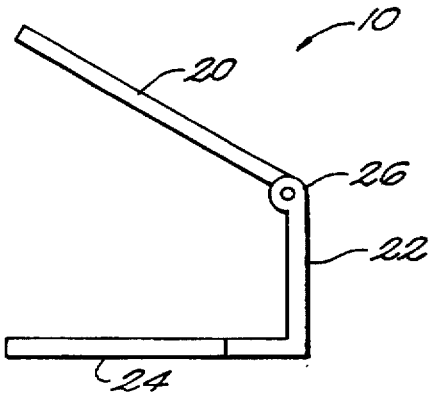
FIG. 2 is a side view of the apparatus of FIG. 1.

In FIG. 2, the apparatus of FIG. 1 is shown in side view. Again, the apparatus 10 includes a radiation source 20, a stand 22, and an adjustable hinge element 26. Also shown in FIG. 2 is a foot element adapted to slide underneath the keyboard and/or otherwise provide stability for the stand.

In FIG. 3, a radiation source 20 is illustrated in conjunction with a resistive heating element 34. The apparatus further includes a cover 32. As illustrated, the resistive heating element is an interdigitated electrode array. Also illustrated in FIG. 3 is an optional heat sensor 40 which can be deployed to measure infrared radiation emitted by the typist's hands and/or the ambient temperature and, thereby, provide feedback control signals to the source of electrical power for the radiation emitter (e.g., the transformer/controller shown in FIG. 1).

In FIG. 4, the structure of the heating source is shown in more detail by a cross-sectional view. As shown, the heating source can include resistive heating element 34, and a heat transporting cover material 32. The cover material 32 can be transparent and can be made of a material such as Kapton™ or Mylar™. The radiation from the source can be redirected, for example, by a back surface of a reflective material 36. The reflector or radiation-directing element can be, for example, a metal-coated polymeric film, or an array of micromirrors, microlenses, Frensnel lenses, fiber reflectors or the like.

In FIG. 5, an alternative structure for a radiation source is shown, again including a resistive heating element 34, a cover 32 and a back reflector 36. In addition, the embodiment of FIG. 5 includes deflector elements 31 which serve to redirect radiation emitted by heating element 34.

In FIG. 6, an alternative embodiment of the radiation source 20A is shown in a structure integrated with a computer monitor 16. As illustrated, the apparatus further includes a hinge element 26A which mounts the radiation source 20A in a pivoting relationship to the monitor 16. Although illustrated with the radiation source integrated to the computer monitor 16, it should be clear that the invention can also be practiced in yet another alternative embodiment in which the radiation source is integrated with the keyboard element 14.

In use, the apparatus of the present invention serves to warm a typist's hands. The natural temperature of the hand (which may vary between 30° C. and about 36° C. nominally) is determined by internal metabolic and vascular processes and by the intensity of energy exchange between the hand and its environment.

These energy exchange processes are based on at least two different principles. The first is the thermal interaction of the hand in contact with the surrounding air. This process depends in a complex way on the temperature and movements of the surrounding air. The second process is radiative interaction which depends, in a very calculable way, on the temperature of the hand and the radiant temperature (or temperatures) of the objects surrounding the hand in its environment. In the present invention, methods and apparatus are employed which primarily influence the radiative interaction of the hands with the environment. These interactions encompass both absorption by the hand and emission from the hand of electromagnetic radiation. For purposes of the discussions below, radiative exchanges between the hand and the surrounding air as well as thermal (convective) interactions between the hand and the air can be ignored.

The material environment of the typist's hands (which includes all of the nearby objects as well as lights, windows and other sources of sunlight) creates electromagnetic radiation, which can be absorbed by hands. The hands'ability to absorb surrounding radiation depends upon its albedo (emission coefficient). The hand's albedo is a strong function of wavelength. In the visible spectrum, the albedo of individuals varies in relation to the amount of melanin, a natural chromophore, in the individual's skin. However, the albedo of the skin in the mid and far IR spectral range is dominated by the absorbing properties of water present in the skin and is close to 1.0.

Accordingly, the present invention is based on the appreciation that a large, close proximity, object (with an albedo of approximately 1.0) at or about the desired temperature of a typist's hands can balance completely the radiative losses of the hand. By disposing such a radiation source in close proximity to the hand, the amount of energy radiated from the hand will be re-absorbed by the hand from a radiation emitted by the close proximity, radiation source. To achieve such a radiation balance with an IR radiation source, it is simply necessary to estimate the radiative balance of the material environment and provide a radiation source sufficient to counteract any environmental heat losses In practice, the invention can be further simplified by providing an adjustable radiation source to ensure that the radiation balance is maintained despite changes in the environment. In practice, a radiation source having a surface area of about 100 square centimeters or more and emitting radiation with an intensity of about 10 to about 150 milliwatts/square centimeter is sufficient to achieve these goals.

What is claimed is:

1. A radiative keyboard heating apparatus comprising:

a source of hand-warming infrared radiation;

a holder for supporting said radiation source above and in proximity to a keyboard, such that a keyboard user's hands can be warmed by radiant energy during typing and wherein said holder having an adjustment means for adjusting the incident angle of said source relative to the keyboard.

2. The apparatus of claim 1 wherein the radiation source emits radiation having an intensity of about 10 to about 150 milliwatts/square centimeter measured at the typist's hands.

3. The apparatus of claim 1 wherein the holder is integrated with a monitor.

4. The apparatus of claim 1 wherein the radiation source is an infrared (IR) radiation source which emits IR radiation in at least a portion of the spectrum from about 1 to about 30 micrometers.

5. The apparatus of claim 1 wherein the radiation source is a large area radiation emitter.

6. The apparatus of claim 1 wherein the radiation source is a large area radiation emitter positioned in relationship to the hands in such distance and orientation that the radiation intensity of the radiation source measured at the radiation source is approximately equal to the radiation intensity measured at the typist's hands.

7. The apparatus of claim 1 wherein the radiation source is a large area radiation emitter having a surface area greater than about 100 square centimeters.

8. The apparatus of claim 1 wherein the radiation source comprises a resistive electric heating element.

9. The apparatus of claim 5 wherein the resistive electric heating element is an etched metal foil element.

10. The apparatus of claim 5 wherein the resistive electric heating element is conductive ceramic element.

11. The apparatus of claim 5 wherein the resistive electric heating element is conductive polymeric element.

12. The apparatus of claim 5 wherein the resistive electric heating element is a thin metal film resistor element.

13. The apparatus of claim 5 wherein the resistive electric heating element is transparent.

14. The apparatus of claim 1 wherein the radiation source comprises a heater element and a radiation transparent cover material through which radiation can be transmitted to a typist's hands.

15. The apparatus of claim 1 wherein the radiation source comprises a heater element and a heat transporting cover material having a surface from which radiation can be emitted to a typist's hands.

16. The apparatus of claim 15 wherein the cover material has an emission coefficient greater than about 0.3.

17. The apparatus of claim 15 wherein the cover material further comprises a Kapton™ material.

18. The apparatus of claim 15 wherein the cover material further comprises a Mylar™ material.

19. The apparatus of claim 1 wherein the radiation source comprises a heater element and a radiation redirecting element to redirect a portion of said radiation towards a user's hand.

20. The apparatus of claim 1 wherein the holder further comprises at least one surface-engaging leg which serves to stabilize the holder and allows for positioning of the radiation source independently of a keyboard.

21. The apparatus of claim 1 wherein the holder is integrated with a keyboard.

* * * * *